US006663460B1

(12) United States Patent
Nelson

(10) Patent No.: US 6,663,460 B1
(45) Date of Patent: Dec. 16, 2003

(54) BALLOON WEIGHT WITH SELECTABLE BALLAST

(75) Inventor: David C. Nelson, Akron, OH (US)

(73) Assignee: Premium Balloon Accessories, Inc., Sharon Center, OH (US)

( * ) Notice: Subject to any disclaimer, the term of this patent is extended or adjusted under 35 U.S.C. 154(b) by 96 days.

(21) Appl. No.: 09/687,894

(22) Filed: Oct. 13, 2000

(51) Int. Cl.[7] ..... A63H 3/06
(52) U.S. Cl. ..... 446/220
(58) Field of Search ..... 446/220, 221, 446/222, 223, 224, 225, 226, 186; 40/212, 214; 248/346, 910

(56) References Cited

U.S. PATENT DOCUMENTS 5,016,848 A * 5/1991 Metz ..... 446/220
5,035,391 A * 7/1991 Steele et al. ..... 446/220
5,074,510 A * 12/1991 Metz ..... 446/220
5,088,952 A * 2/1992 Goldblatt ..... 446/220
5,415,607 A * 5/1995 Carpenter ..... 482/106
5,662,510 A * 9/1997 Wolens ..... 446/220
5,755,419 A * 5/1998 Gearhart et al. ..... 446/220
5,938,154 A * 8/1999 Bartels ..... 248/364.01
6,234,934 B1 * 5/2001 Gorczyca ..... 482/108

* cited by examiner

*Primary Examiner*—Jacob K. Ackun
*Assistant Examiner*—Faye Francis
(74) *Attorney, Agent, or Firm*—Renner, Kenner, Greive, Bobak, Taylor & Weber

(57) ABSTRACT

A balloon weight assembly includes a spool having a cavity defined in a body portion thereof. The cavity is configured to securingly receive and retain a ballast weight of selectable mass therein. The cavity is further sized to receive more than one such ballast weight at a time in a press fit manner. Accordingly, a single weight housing may be adapted to provide retaining downforce to balloons of various sizes or "lift."

1 Claim, 1 Drawing Sheet

BALLOON WEIGHT WITH SELECTABLE BALLAST

TECHNICAL FIELD

The invention herein resides in the art of balloon devices and accessories. More particularly, the invention relates to a balloon weight assembly adapted to be tethered to an inflated balloon in restraint thereof. Specifically, the invention relates to a balloon weight assembly adapted to provide ballast in various amounts. Particularly, the balloon weight is characterized by a cavity configured to receive weights of various masses, as described.

BACKGROUND ART

The use of balloons as a "favor" or at parties, celebrations, and other events is now extremely well known. Millions of balloons are so used each year. Generally such balloons are attached to either a stick and a cup or a ribbon so that they can be restrained by the user. Additionally, the balloons are typically filled with helium gas to provide a "lift", allowing them to stay aloft at the end of the tethered ribbon. Of particular concern of many localities is assurances that such inflated balloons are restrained from free flight into electrical power lines and transformers as well as the atmosphere. Particular concern exists with respect to Mylar or metallic balloons, which pose a threat to electrical transmission wires, and which are not biodegradable. Many municipalities and other governmental agencies consider such balloons to pose at least some threat to the environment. Accordingly, many governmental agencies require that such metallic balloons be tethered to a weight, with the weight being sufficient to prevent the balloon from free flight into the atmosphere.

It has previously been known to employ a weight at the end of a ribbon tethered to a balloon, to restrain the balloon from free flight. But, the size of the weight necessary to prevent escape of the balloon is a function of the size or "lift" of the balloon. In the past, it has been necessary for retailers to have available a wide variation of balloon weights in order to accomodate the various sizes of balloons being sold. The need for such a wide variety of balloon weights aggravates costs of both manufacturing and inventory.

DISCLOSURE OF INVENTION

In light of the foregoing, it is an aspect of the instant invention to provide a balloon weight with selectable ballast in which a housing has a cavity adapted to receive weights of various masses dependent upon the size or "lift" of the associated balloon.

The foregoing and other aspects of the invention which will become apparent as the detailed description proceeds are achieved by a balloon weight housing having a cavity configured to selectively receive weights of various masses, such weights being received in the cavity by a press fit.

DESCRIPTION OF THE DRAWINGS

For a complete understanding of the objects, techniques, and structure of the invention reference should be made to the following detailed description and accompanying drawings wherein.

BEST MODE FOR CARRYING OUT THE INVENTION

With reference now to the drawings, it can be seen that a balloon weight made in accordance with the invention is designated generally by the numeral 10. As is known in the art, the balloon weight 10 is generally configured as a spool and is preferably molded of plastic and has a body with an eyelet or the like for securedly receiving the end of a tether, the other end of the tether being adapted for attachment to a balloon.

Figure 1:
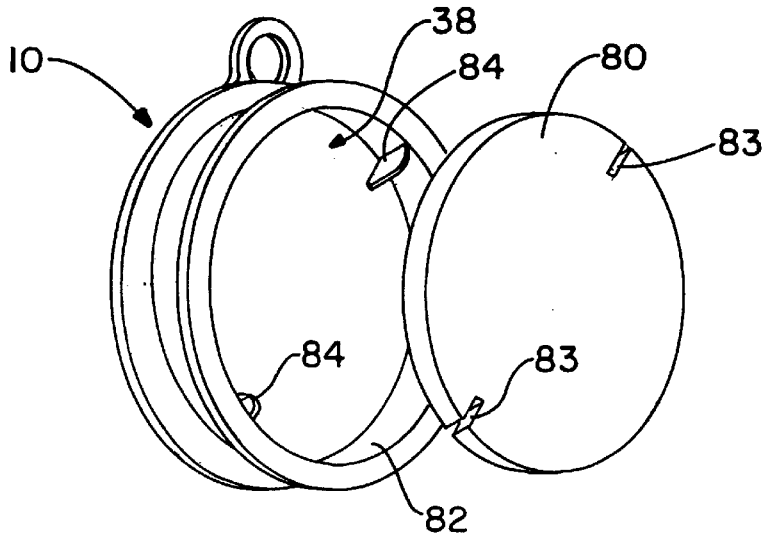
FIG. 1 is a perspective view of a balloon weight according to the invention and in which a ballast is press fit into a cavity within the housing of the balloon weight.
Figure 2:
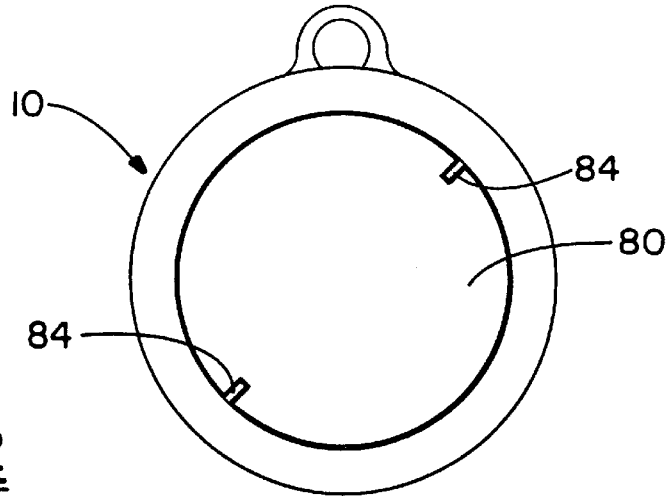
FIG. 2 is a rear elevational view of the balloon weight of FIG. 1, showing the ballast in place.
Figure 3:
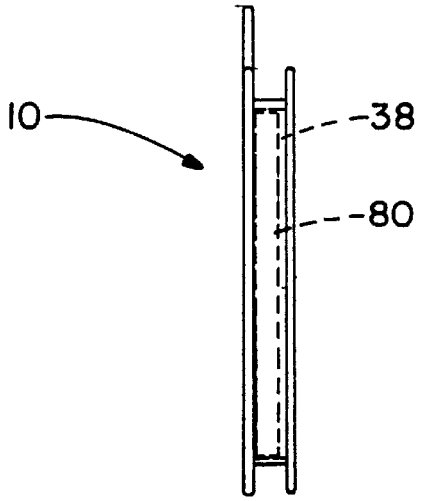
FIG. 3 is a side elevational view of the balloon weight of FIG. 1.

It will be appreciated that balloons come in various sizes and associated "lifts." Moreover, balloons are often ganged together, having a significant "lift" characterizing the group of balloons. Rather than being numerous individual balloon weights from which the appropriate weight may be selected, the invention contemplates a single weight with selectably interchangeable ballasts. To that end, as shown in FIGS. 1–3, the balloon weight 10 may be provided with at least one ballast member 80. The ballast member 80 simply provides additional downforce or weight to the balloon weight 10. It may be constructed of any known material including metals, polymeric materials, and combinations thereof. The ballast member 80 may be coated. For example, a metal ballast member 80 may comprise a lead core having a polymeric coating. Ballast member 80 is made attachable to the balloon weight 10 in any known manner. In the embodiment shown, ballast member 80 is sized to create a friction or interference fit with the internal wall 82 of cavity 38 in the molded body of the balloon weight 10. In this way, as shown in FIG. 2, the ballast member 80 may be simply pressed or snapped into place by the user.

The ballast member 80 is shown as a cylindrical disk member for sake of simplicity, but it will be appreciated that any shape ballast member 80 may be used with attention to the confines of the cavity 38. The ballast member 80 may further be provided with or shaped to define openings, notches, or recesses, generally indicated by the numeral 83. These openings 83 may be formed at the periphery of member 80. Openings 83 may be located to receive or avoid items that protrude into the cavity, including the knotted ribbon typically associated with balloon weights or support ribs 84 as shown in FIGS. 1 and 2.

As will be appreciated, the weight of the ballast member 80 may be varied in a conventional manner including altering the amount of material forming the ballast member 80 or the density of that material. In addition, the size, shape, or thickness of the ballast member 80 may be changed, or perforations may be used to remove material from the ballast member 82. In terms of density, differing materials may be used as previously mentioned. Finally, the user may change the amount of ballast by substituting ballast members 80 of differing weights or, by adding multiple ballast members 80 within cavity 38. To that end, ballast members 80 may have thicknesses less than the depth of cavity 38 as shown in FIG. 3. Accordingly, any size or combination of ballasts may be employed to satisfy the weight requirements for overcoming the "lift" of an associated balloon. Thus, the ballast members 80 may be used to insure that the balloon floats properly and to avoid instances where the balloon's lift exceeds the downforce of the balloon weight 10.

Thus it can be seen that at least one of the objects of the invention have been satisfied by the structure presented above. While in accordance with the patent statutes only the best mode and preferred embodiment of the invention has been presented and described in detail, the invention is not limited thereto or thereby. Accordingly, for an appreciation of the true scope and breadth of the invention, reference should be made to the following claims.

What is claimed is:

1. A balloon weight assembly for providing a balloon weight for attachment to a balloon comprising:

a body portion configured to receive a tether:

a cavity defined within said body portion; and a plurality of weighted ballasted members, each separate and distinct from said body portion and separately capable of directly attaching to said cavity, wherein at least one of said plurality of weighted ballasted members is of a different mass than another of said plurality of weighted ballasted members such that it is possible to provide balloon weights of different mass with the balloon weight assembly.

* * * * *